US007131601B2

(12) United States Patent
Nolte et al.

(10) Patent No.: US 7,131,601 B2
(45) Date of Patent: Nov. 7, 2006

(54) ROTATIONAL ATOMIZER TURBINE AND ROTATIONAL ATOMIZER

(75) Inventors: Hans J. Nolte, Stuttgart (DE); Harry Krumma, Bönnigheim (DE); Frank Herre, Oberriexingen (DE); Michael Baumann, Flein (DE); Stefano Giuliano, Gerlingen (DE); Bjorn Lind, Gotebörg (SE)

(73) Assignee: Durr Systems, Inc., Plymouth, MI (US)

( * ) Notice: Subject to any disclaimer, the term of this patent is extended or adjusted under 35 U.S.C. 154(b) by 361 days.

(21) Appl. No.: 10/895,446

(22) Filed: Dec. 17, 2003

(65) Prior Publication Data

US 2005/0258270 A1 Nov. 24, 2005

(30) Foreign Application Priority Data

Aug. 6, 2002 (DE) ..... 102 36 017

(51) Int. Cl.
*B05B 3/10* (2006.01)
*B05B 5/00* (2006.01)
*B05B 1/34* (2006.01)

(52) U.S. Cl. ..... 239/224; 239/223; 239/222.11; 239/222.17; 239/296; 239/700; 239/702; 239/708; 239/380

(58) Field of Classification Search ..... 239/700, 239/702, 708, 223, 224, 463, 380, 222.11, 239/222.13, 222.17, 290, 296, 298, 301
See application file for complete search history.

(56) References Cited

U.S. PATENT DOCUMENTS 4,589,597 A * 5/1986 Robisch et al. ..... 239/703
4,896,834 A 1/1990 Coeling et al.
5,662,278 A 9/1997 Howe et al.
5,697,559 A * 12/1997 Davis et al. ..... 239/703
5,803,372 A 9/1998 Weinstein et al.
5,853,126 A * 12/1998 Alexander ..... 239/223
5,922,131 A 7/1999 Haas

FOREIGN PATENT DOCUMENTS

DE 10053295 C2 10/2002
DE 10236017 B3 5/2004
EP 1388372 B1 10/2004

* cited by examiner

*Primary Examiner*—Dinh Q. Nguyen
(74) *Attorney, Agent, or Firm*—Howard & Howard Attorneys, P.C.

(57) ABSTRACT

A rotational atomizer turbine of the present invention is designed to drive a bell-shaped disk in a rotational atomizer for a coating unit. The rotational atomizer turbine includes a housing, a rotatable turbine wheel with several turbine blades connected to a shaft and rotatably disposed in the housing. A plurality of nozzles are defined in the housing and are positioned relative the turbine wheel to drive fluid, i.e. gas onto the turbine blades. An intermediate chamber formed in the housing is fluidly communicated with and connected to the nozzles to hold gas therein. The intermediate chamber has a first inlet to supply gas. At least a second inlet is defined in the intermediate chamber for delivering gas into the intermediate chamber thereby increasing amount of gas therein to multiply a rotational speed of the rotatable turbine wheel as increased amount of gas is introduced to the turbine blades.

52 Claims, 2 Drawing Sheets

ROTATIONAL ATOMIZER TURBINE AND ROTATIONAL ATOMIZER

RELATED APPLICATION

The subject patent application claims priority to and all the benefits of U.S. Provisional Patent Application Ser. No. 60/530,404 filed on Dec. 17, 2003 and German patent Application Serial No. 102 36 017. D filed on Jun. 8, 2002.

FIELD OF THE INVENTION

This invention relates to a rotational atomizer turbine to drive a bell-shaped disk in a rotational atomizer for a coating unit.

BACKGROUND OF THE INVENTION

In modern lacquering units, rotational atomizers are used, as is known, in which a so-called bell-shaped disk is driven at high rotational speeds by a compressed air turbine. The bell-shaped disk, as a rule, has the shape of a truncated cone and expands in the spraying direction, wherein the coating material to be applied is accelerated axially and especially radially in the bell-shaped disk in the shape of a truncated cone as a result of centrifugal forces, so that a cone-shaped spray jet is formed on the outline edge of the bell-shaped disk. The rotational speed of the compressed air turbine is in the range of 15,000 to 80,000 rpm. At high rotational speeds of the compressed air turbine, it may happen, however, that the driving performance upon opening the main needle with a subsequent supply of coating material is not sufficient, so as to maintain constant at the desired value the rotational speed of the compressed air turbine. In this way, the rotational speed of the compressed air turbine could drop by up to 20% upon opening the main needle of the rotational atomizer, wherein the lacquering quality would be impaired.

The goal of the invention is therefore to improve a rotational speed of the rotational atomizer and eliminate a vibration of a rotatable turbine wheel to improve driving torque of the rotatable turbine wheel.

SUMMARY OF THE INVENTION

A rotational atomizer turbine of the present invention is designed to drive a bell-shaped disk in a rotational atomizer for a coating unit. The rotational atomizer turbine includes a housing surrounding an axis, a rotatable turbine wheel with several turbine blades disposed in the housing. A plurality of turbine blades extend from the rotatable turbine wheel and are radially spaced relative to the axis. An intermediate annular chamber is defined in the housing and is fluidly connected to a plurality of nozzles to hold fluid therein. The plurality of nozzles are defined angularly in the annular chamber for driving fluid onto the turbine blades. A first inlet is defined in the annular chamber for delivering fluid into the annular chamber. At least one second inlet is defined in the annular chamber for delivering fluid into the annular chamber thereby increasing amount of fluid in the annular chamber to increase a rotational speed of the rotatable turbine wheel as increased amount of fluid is introduced to the turbine blades through the plurality of nozzles. A brake nozzle is defined in the housing for driving fluid to onto the turbine blades in a direction reverse to the angular direction of fluid driven through the nozzles thereby decreasing a rotational speed of as rotatable turbine wheel when required.

An advantage of the present invention is to provide several inlets defined in the intermediate annular chamber instead of one individual enlarged inlet.

Another advantage of the present invention is to provide a brake nozzle defined in the housing for driving fluid to onto the turbine blades in a direction reverse to the direction of fluid driven through the nozzles to control rotational speed of rotatable turbine wheel.

Still another advantage of the present invention is to eliminate vibration of the rotatable turbine wheel in operation mode of the inventive rotational atomizer turbine due to unique location of the nozzles.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
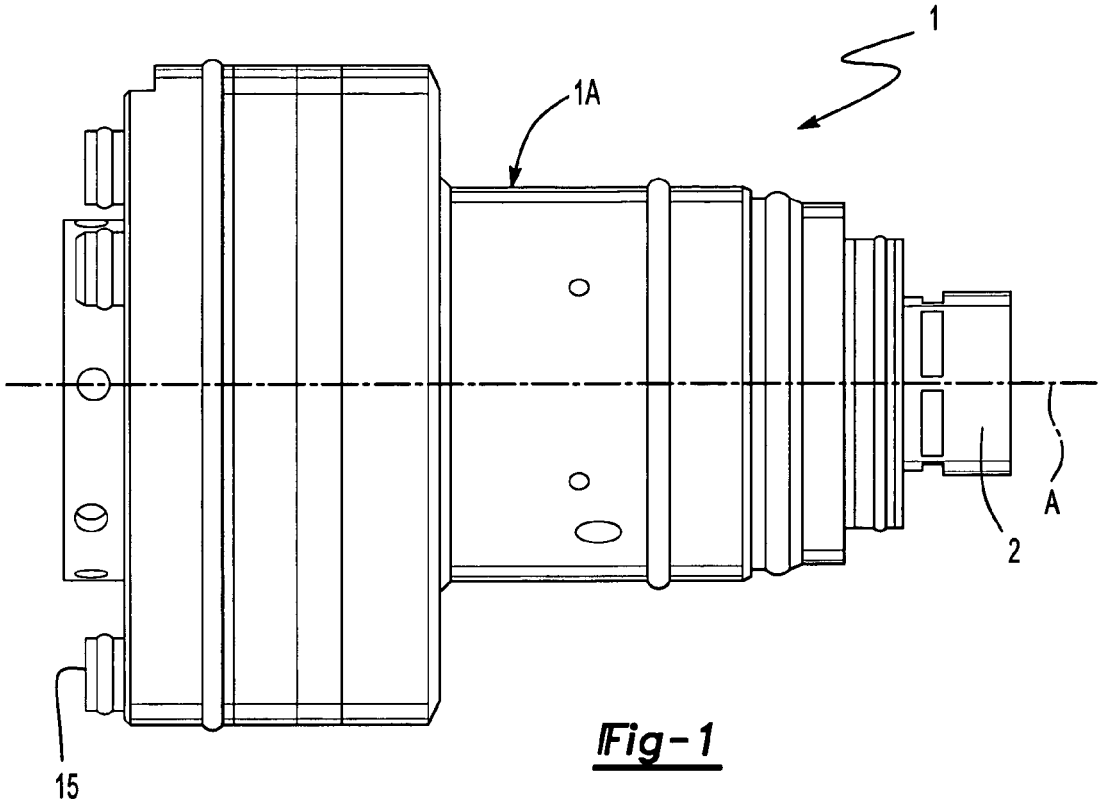
FIG. 1 is a schematic side view of a rotational atomizer turbine, in accordance with the invention.
Figure 2:
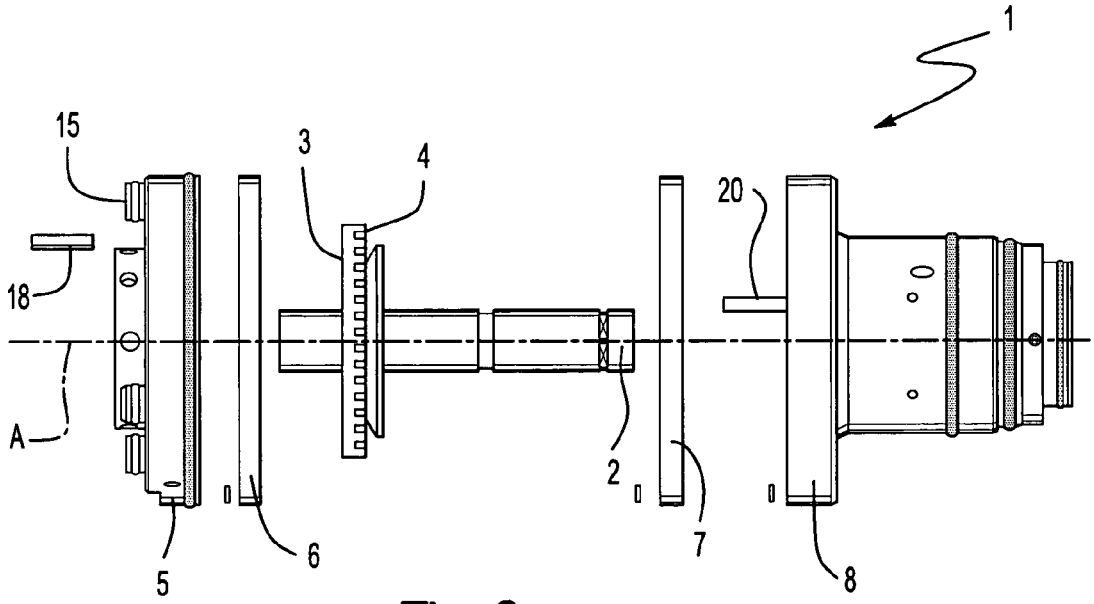
FIG. 2 is an exploded view of the rotational atomizer turbine shown in FIG. 1.

Referring to the Figures, wherein like numerals indicate like or corresponding parts, a rotational atomizer turbine is generally shown at 1 in FIGS. 1 and 2, and is used in combination with a rotational atomizer (not shown) of a lacquering unit. The rotational atomizer turbine 1 includes a housing 1*a* circumscribing an axis A. A bell-shaped disk shaft 2 is rotatably supported by the housing 1*a*. A bell-shaped disk, is mounted on the bell-shaped disk shaft 2. A turbine wheel 3 is connected to the bell-shaped disk shaft 2. The turbine wheel 3 presents a circular disk extending to a peripheral rim. A plurality of turbine blades 4 are formed on the side of the turbine wheel 3 and are radially spaced relative to the axis A. The housing 1*a* of the rotational atomizer turbine 1, in accordance with the invention, has several housing parts, as shown in FIG. 2. The housing parts include a front plate 5, a neck portion 8, first 6 and second 7 core plates disposed between the front plate 5 and the neck portion 8. The first and second core plates 6 and 7 are shaped in the form of a circular ring. The first core plate 6 surrounds the turbine wheel 3, as shown in the mounted state, so that the interior of the first core plate 6 forms a cylindrical turbine chamber, in which the turbine wheel 3 is rotated. An annular intermediate chamber 12 is machined into the first core plate 6 of the housing 1*a*. The annular intermediate chamber 12 is covered by the second core plate 7 in the mounted state to form a chamber.

A first inlet 13 is defined in the annular intermediate chamber 12 for delivering fluid into the annular intermediate chamber 12. At least one second inlet 14 is defined in the annular intermediate chamber 12 for delivering fluid into the annular intermediate chamber 12 thereby increasing amount of fluid in the annular intermediate chamber 12 to increase a rotational speed of the rotatable turbine wheel 3 as increased amount of fluid is introduced to the turbine blades 4 through the plurality of nozzles 9 through 11. The arrangement of the inlets 13 and 14 relative to the annular intermediate chamber 12 allows that the natural flow movement is supported within the annular intermediate chamber 12.

Preferably, the nozzles 9 through 11 are Lavalle nozzles for driving fluid onto the turbine blades 4. The nozzles 9 through 11 are separated from the annular intermediate chamber 12. The nozzles 9 through 11 are asymmetricaly disposed relative the axis A. The nozzles 9 through 11 are angularly and vortecaly spaced relative to the axis A for rotating the turbine blades 4 thereby rotating the turbine wheel 3. An annular distance is defined between the nozzles 9 through 11 and the turbine wheel 3 for driving fluid onto every other turbine blade 4. At least one of the nozzles 9 through 11 is defined between the first inlet 13 and at least one of the second inlets 14. The nozzles 9 through 11 drive fluid in unison into the hollow chamber of the first core plate 6 for facilitating uniformed application of fluid onto the turbine blades 4. The nozzles 9 through 11 are oriented in the circumferential direction over an angle range of approximately 130°, relative to the axis A of the turbine wheel 3.

Figure 3:
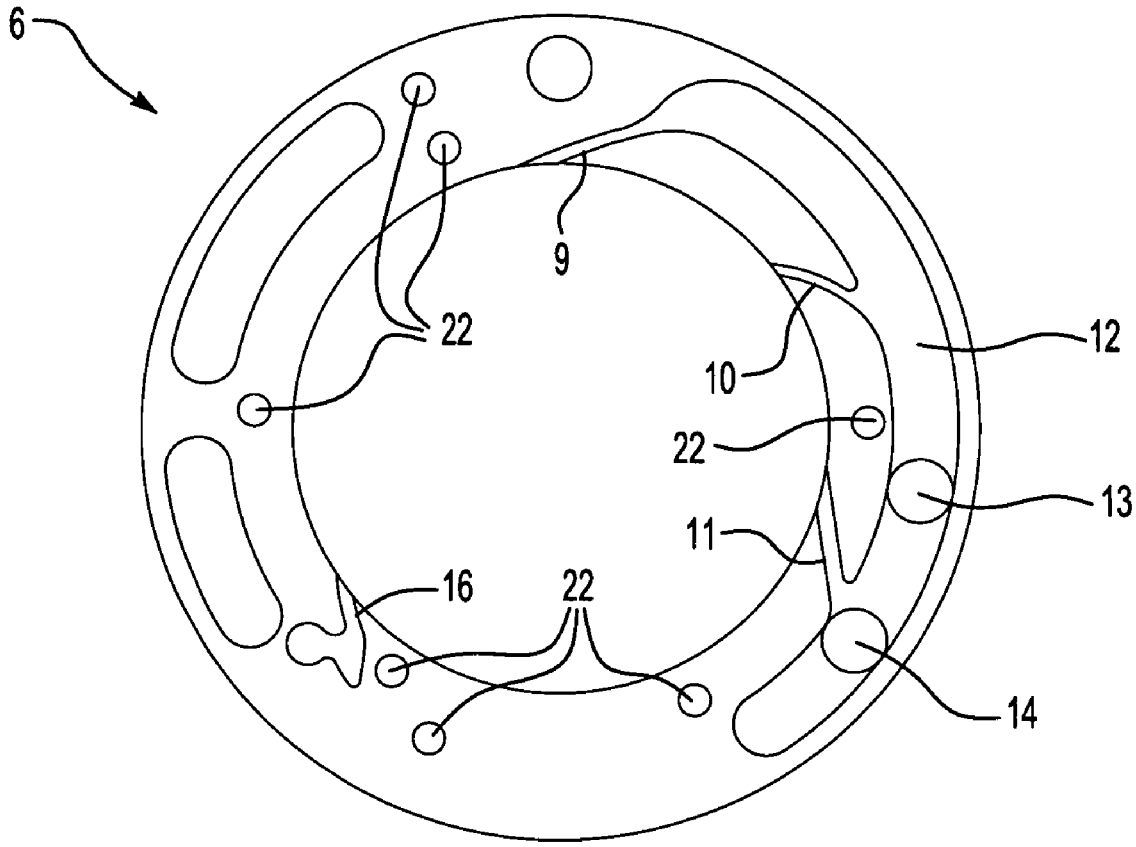
FIG. 3 is a nozzle ring of the rotational atomizer turbine shown in FIGS. 1 and 2.

Alluding to the above, the first inlet 13 and the second inlets 14 discharge fluid axially into the intermediate chamber 12. The first and second inlets 13 and 14 present a circular cross-section with a diameter of 5 mm. The first inlet 13 and the second inlets 14 are exposed to the intermediate chamber 12 to discharge fluid into the intermediate chamber 12. As shown in FIG. 3, the first and second inlets 13 and 14 exposed within the annular intermediate chamber 12, are located in the upper half of the annular intermediate chamber 12. The majority of the Lavalle nozzles 9 through 11 are located on the lower half relative to the first and second inlets 13 and 14.

The first and second inlets 13 and 14 are fluidly and separately communicated with supply lines or hoses for receiving fluid. The supply lines are cooperable one with the other and are fluidly communicated with a common source of fluid supply (not shown). The supply lines are further defined by hoses (not shown) on at least a part of their length and a plurality of inlet ports 15 connected to the front plate 5. The supply lines have a cross-section between 5 $mm^2$ and 80 $mm^2$ on at least a part of their length.

Referring back to FIG. 2, a pair of pins 18 and 20 extend through openings 22 defined in the rear plate 5, the first and the second core plates 6 and 7, and the neck portion 8 and extend through the rear plate 5, the first and the second core plates 6 and 7 of the housing 1 to lock these parts together in assembled mode and prevent side movement of the rear plate 5, the first and the second core plates 6 and 7, and the neck portion 8 relative to one another.

The Lavalle nozzles 9–11 are exposed to a jacket or a cylindrical turbine chamber, wherein during the operation, gas or fluid is blown onto the individual turbine blades 4 of the turbine wheel 3. The Lavalle nozzles 9–11 are connected with the annular intermediate chamber 12, which is located within the housing part 6 and runs in the circumferential direction over an angle range of approximately 130°, relative to the axis A of the turbine wheel 3. The annular intermediate chamber 12 is milled into the housing part or the first core plate 6 and is exposed to an opening on one side. The annular intermediate chamber 12 is covered by the housing part or the second core plate 7, to cover the opening in the mounted state. The first and second inlets 13, 14, which have a circular cross-section with a diameter of 5 mm, discharge fluid in the axial direction into the annular intermediate chamber 12.

The arrangement of the Lavalle nozzles 9–11, the majority of which are located on the downstream side of the first and second inlets 13, 14, provides for discharge of fluid into the jacket. Furthermore, the rotational atomizer turbine 1, in accordance with the invention, has another nozzle 16 in the housing part 6, so as to brake rotational movement of the individual turbine blades 4 of the turbine wheel 3 by virtue of fluid or air blown on them in the reverse direction. The invention is not limited to the preferred embodiment, described above and includes various alternative embodiments described further below. Rather, a large number of variants and modifications are possible, which also make use of the inventive idea and therefore fall into the protection range.

The turbine wheel 3 and the turbine blades 4, may include alternative design. Thus, the turbine wheel 3 can have a circular disk, from which the individual turbine blades 4 extend outwardly axially. Instead of such the turbine wheel 3, which is closed on one side and open on one side, however, it is also possible to use a the turbine wheel 3, is closed axially on both sides, in which the turbine blades 4 are located in the axial direction, between two circular disks (not shown). The removal of the blown-in driving gas or fluid can take place by outlets in the vicinity of the axis A of the turbine wheel 3, wherein the outlets can be provided on one side or on both sides in the circular disks. Moreover, there is also the possibility that the turbine wheel 3 is open in the axial direction, on both sides, wherein the turbine blades 4 are located on the jacket surface of a rotating hub (not shown). The invention, however, is not limited to the constructive designs of the turbine wheel, described, by way of example, in the preceding.

With regard to the constructive design of the individual turbine blades 4, there are various alternative embodiments. For example, the individual turbine blades 4 can have a shape which may be curved in the radial direction, but not in the axial direction. This is favorable with regard to manufacturing technology, since the individual turbine blades 4 can then be produced in a milling process. This design of the turbine blades presents many advantages, especially with a turbine wheel 3 which is closed on one side and open on one side, in the axial direction, since the turbine blades 4 can thereby be milled out from one circular disk on its circumferential rim (not shown).

Alternately, however, it is also possible for the individual turbine blades 4 to be curved both in the axial direction as well as in the radial direction, so as to attain an optimal impulse transfer from the driving gas onto the turbine blades 4. The aforementioned shape of the turbine blades 4 is possible, particularly if the turbine blades 4 are manufactured separately and are only subsequently affixed to the turbine wheel 3. Furthermore, the individual turbine blades 4 can have a chamber or a reception opening, but it is also possible for the The individual turbine blades 4 may have two chambers or reception indentations, which are located next to one another in the axial direction.

Alluding to the above and in accordance with the present invention, the rotational atomizer turbine 1 may include several additional nozzles to blow fluid or driving gas onto the turbine blades 4 wherein the nozzles are preferably designed as Lavalle nozzles, as previously discussed, or similar to a Lavalle nozzle, which is favorable for flow technology. By using several inlets to the annular intermediate chamber 12 for the supply of the driving gas, the driving performance of the rotational atomizer turbine 1 is increased, so that a drop in the rotational speed does not occur or is reduced to a minimum when the main needle is opened.

The intermediate chamber 12 preferably also brings about a dampening of the gas flow, because the intermediate chamber 12 has a storage capacity. In a preferred embodiment of the invention, as previously discussed, at least three nozzles are used to blow fluid onto the turbine blades 4, but nozzles may be used to attain higher rotational speeds of the bell-shaped disk or to drive the bell-shaped disk with a greater turning moment. Preferably, the intermediate chamber 12 is located in a surrounding annular shape with respect to the axis A of the turbine wheel 3, wherein the intermediate chamber 12 can extend, for example, by an angle range of 90° to 270°, with respect to the axis A of the turbine wheel 3. In a preferred embodiment of the rotational atomizer turbine 1, in accordance with the present invention, the annular intermediate chamber 12 surrounds the turbine wheel 3 in a radial direction. Alternatively, the annular intermediate chamber 12 may be located next to the turbine wheel 3 in the axial direction, wherein the driving gas is laterally blown into the turbine wheel 3. This design of the annular intermediate chamber 12 is, in particular, possible wherein the turbine wheel 3 is open, in the axial direction, on one side or on both sides.

Referring back to the nozzles 9 through 11, the location of the nozzles relative to the annular intermediate chamber 12 may vary. The individual nozzles 9 through 11 may be angularly oriented respect to the axis A of the turbine wheel 3 and non-unevenly spaced relative to the adjacent turbine blades 4.

Preferably, at least one of the nozzles that blows fluid onto the turbine blades 4 is spaced between two inlets 13 and 14 of the annular intermediate chamber 12, which is favorable for flow technology. Moreover, the flow of fluid or driving gas blown through the nozzles is essentially change gradually, without being interrupted by a heel, into the aforementioned hollow-cylindrical turbine chamber or jacket.

The hollow-cylindrical turbine chamber preferably has a smooth, heel-free, inside contour, which is merely interrupted in the immediate area of the nozzles by the nozzle opening. Preferably, additional nozzles in the intermediate chamber 12 on the downstream side of each inlet, than on the upstream side. Preferably, all nozzles in the intermediate chamber 12 lie on the downstream side of the supply lines. Alternatively, the individual nozzles may be arranged, asymmetrically to be distributed over the circumference. For example, the annular intermediate chamber 12 may extend over an angle range of only approximately 110°, with respect to the axis A of the turbine wheel 3, wherein all nozzles are located within this angle range.

Alluding to the above, the inlets 13 and 14 exposed into the intermediate chamber 12 may be arranged or formed in such a way that the natural flow movement exists within the intermediate chamber 12. For example, the inlets 13 and 14 can be inclined in the direction of flow, in the circumferential direction, into the intermediate chamber 12, so that the flow of driving gas is pre-directed in the circumferential direction upon entering the intermediate chamber 12.

Moreover, the invention also comprises the aforementioned complete rotational atomizer with the rotational atomizer turbine 1, described in the preceding and in accordance with the invention. Preferably, the individual inlets 13 and 14 of the intermediate chamber 12 connected individually with separate supply lines for the driving gas, may present an operative communication with a separate control and regulation of the supply of the driving gas for the two inlets 13 and 14. On the other hand, the separate supply lines permit relatively small individual cross-sections with a sufficient total cross-section of the supply lines, so that the individual supply lines can be guided better within the coating unit. Preferably, the supply lines therefore consist of hoses on at least one part of their length; they are flexible and with an arrangement of the rotation atomizer on a lacquering robot to follow the movement of the lacquering robot. Alternatively, the individual supply lines connected to the inlets 13 and 14 of the intermediate chamber 12 of the rotational atomizer turbine 1 are brought together upstream and are fed from a common source of driving gas supply. In a preferred embodiment of the invention, the individual supply lines have a cross-section between 5 $mm^2$ and 80 $mm^2$ on at least a part of their length.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A rotational atomizer turbine fluidly communicating with a source of fluid supply for driving a bell of a rotational atomizer for a coating unit, said rotational atomizer turbine comprising;

a housing having at least one attacheable member surrounding an axis;

a rotatable turbine adaptable for rotating the bell is disposed in said housing surrounding said axis, a plurality of turbine blades of said rotatable turbine radially spaced relative to the axis, and an intermediate chamber defined between said housing and said at least one attachable member with said intermediate chamber being partially exposed to said plurality of turbine blades at spaced locations for distributing fluid from the source of fluid supply and to direct fluid relative to said plurality of turbine blades thereby rotating said turbine blades around the axis.

2. A rotational atomizer turbine as set forth in claim 1 wherein said at least one attachable member is further defined by a circular plate having a plurality of nozzles defined in said circular plate for driving fluid in an angular direction onto said turbine blades.

3. A rotational atomizer turbine as set forth in claim 2 wherein said plurality of nozzles is further defined by three nozzles.

4. A rotational atomizer turbine as set forth in claim 3 wherein said nozzles are oriented in the circumferential direction over an angle range of approximately 130° relative to said axis.

5. A rotational atomizer as set forth in claim 4 including a first inlet defined in said intermediate chamber for delivering fluid into said intermediate chamber.

6. A rotational atomizer as set forth in claim 5 including at least one second inlet defined in said intermediate chamber for delivering fluid into said chamber thereby increasing amount of fluid in said intermediate chamber to increase a rotational speed of said rotatable turbine as fluid is introduced to said turbine blades through said plurality of nozzles.

7. A rotational atomizer turbine as set forth in claim 6 wherein said intermediate chamber presents an annular form and circumscribes said axis of said turbine extending in a radial direction surrounding said turbine externally.

8. A rotational atomizer turbine as set forth in claim 7 wherein said nozzles present an annular distance defined between said nozzles and said turbine for driving fluid onto every other of said turbine blades to reduce vibration of said rotatable turbine thereby improving a driving torque of said rotatable turbine.

9. A rotational atomizer turbine as set forth in claim 8 wherein at least one of said nozzles is defined between said first inlet and at least one of said second inlets.

10. A rotational atomizer turbine as set forth in claim 6 wherein said nozzles drive fluid in unison into a hollow chamber of said housing for facilitating uniformed application of fluid onto said turbine blades.

11. A rotational atomizer turbine as set forth in claim 10 wherein additional nozzles are spaced from said intermediate chamber on the downstream side of each of said first and second inlets than on the upstream side.

12. A rotational atomizer turbine as set forth in claim 11 wherein all of said nozzles are oriented on the downstream side of said first inlet and said at least second inlet branch off from said intermediate chamber.

13. A rotational atomizer turbine as set forth in claim 12 wherein said nozzles are asymmetrically disposed relative said axis.

14. A rotational atomizer turbine as set forth in claim 2 wherein said nozzles are Lavalle nozzles.

15. A rotational atomizer turbine, as set forth in claim 6 wherein said first inlet and said at least one second inlet are fluidly and separately communicated with supply lines for receiving fluid.

16. A rotational atomizer turbine as set forth in claim 15 wherein said supply lines are cooperable one with the other and are fluidly communicated with a common source of fluid supply.

17. A rotational atomizer turbine as set forth in claim 16 wherein said supply lines are defined by hoses.

18. A rotational atomizer turbine as set forth in claim 17 wherein said supply lines have a cross-section between 5 $mm^2$ and 80 $mm^2$.

19. A rotational atomizer turbine as set forth in claim 1 wherein fluid is defined by gas.

20. A rotational atomizer turbine as set forth in claim 1 including a shaft circumscribing said axis with said rotatable turbine connected to said shaft.

21. A rotational atomizer turbine as set forth in claim 2 wherein said housing is further defined by a front plate, a neck portion, and a second circular plate with said circular plate defining said intermediate chamber disposed between said front plate and said second circular plate.

22. A rotational atomizer turbine, as set forth in claim 21 including a brake nozzle defined in said first core plate for driving fluid onto said turbine blades in a direction reverse to the direction of fluid driven through said nozzles thereby decreasing a rotational speed of said rotatable turbine.

23. A rotational atomizer turbine fluidly communicated with a source of fluid supply for driving a bell of a rotational atomizer for a coating unit, said rotational atomizer turbine comprising;

a housing having at least one attachable member surrounding an axis;

a rotatable turbine wheel adaptable for rotating the bell and disposed in said housing surrounding said axis;

a plurality of turbine blades of said rotatable turbine wheel radially spaced relative to said axis;

an intermediate chamber defined in said at least one attachable member being partially exposed to said plurality of turbine blades for distributing fluid from the source of fluid supply and to direct fluid relative to said plurality of turbine blades thereby rotating said turbine blades about said axis;

a first inlet defined in said intermediate chamber for delivering fluid into said intermediate chamber; and at least one second inlet defined in said intermediate chamber for delivering fluid into said intermediate chamber thereby increasing amount of fluid in said intermediate chamber to increase a rotational speed of said rotatable turbine wheel as fluid is introduced to said turbine blades through said intermediate chamber with said first inlet and said at least one second inlet being fluidly and separately communicated with supply lines for receiving fluid.

24. A rotational atomizer turbine as set forth in claim 23 wherein said at least one attachable member is further defined by a circular plate having a plurality of nozzles defined in said circular plate for driving fluid in an angular direction onto said turbine blades.

25. A rotational atomizer turbine as set forth in claim 24 wherein said plurality of nozzles is further defined by three nozzles.

26. A rotational atomizer turbine as set forth in claim 25 wherein said nozzles are oriented in the circumferential direction over an angle range of approximately 130° relative to said axis.

27. A rotational atomizer turbine as set forth in claim 26 wherein said intermediate chamber presents an annular form and circumscribes said axis of said turbine wheel extending in a radial direction surrounding said turbine wheel externally.

28. A rotational atomizer turbine as set forth in claim 27 wherein said nozzles drive fluid onto every other of said turbine blades.

29. A rotational atomizer turbine as set forth in claim 28 wherein at least one of said nozzles is defined between said first inlet and at least one of said second inlets.

30. A rotational atomizer turbine as set forth in claim 29 wherein said nozzles drive fluid in unison into a hollow chamber of said housing for facilitating uniformed application of fluid onto said turbine blades wherein fluid is driven onto every other of said turbine blades to reduce vibration of said rotatable turbine wheel thereby improving a driving torque of said rotatable turbine wheel.

31. A rotational atomizer turbine as set forth in claim 30 wherein additional nozzles are spaced from said intermediate chamber on the downstream side of each of said first and second inlets than on the upstream side.

32. A rotational atomizer turbine as set forth in claim 30 wherein all of said nozzles are oriented on the downstream side of said first inlet and said at least second inlet branch off from said intermediate chamber.

33. A rotational atomizer turbine as set forth in claim 32 wherein said nozzles are asymmetrically disposed relative said axis.

34. A rotational atomizer turbine as set forth in claim 33 wherein said supply lines are cooperable one with the other and are fluidly communicated with a common source of fluid supply.

35. A rotational atomizer turbine as set forth in claim 34 wherein said supply lines are defined by hoses on at least a part of their length.

36. A rotational atomizer turbine as set forth in claim 23 wherein fluid is defined by gas.

37. A rotational atomizer turbine as set forth in claim 23 including a shaft circumscribing said axis with said rotatable turbine wheel connected to said shaft.

38. A rotational atomizer turbine as set forth in claim 23 wherein said housing is further defined by a front plate, a neck portion, and a second circular plate with said circular plate defining said chamber disposed between said front plate and said second circular plate.

39. A rotational atomizer turbine as set forth in claim 23 including a brake nozzle defined in said circular plate for driving fluid to onto said turbine blades in a direction reverse to the direction of fluid driven through said nozzles thereby decreasing a rotational speed of said rotatable turbine wheel.

40. A rotational atomizer turbine fluidly communicated with a source of fluid supply for driving a bell of a rotational atomizer for a coating unit, said rotational atomizer turbine comprising;

a housing having at least one attachable member defining a pair of nozzles surrounding an axis;

a rotatable turbine wheel adaptable for rotating the bell and disposed in said housing surrounding said axis;

a plurality of turbine blades of said rotatable turbine wheel radially spaced relative to said axis;

an intermediate chamber defined in said at least one attachable member being partially exposed to said plurality of turbine blades for distributing fluid from the source of fluid supply and to direct fluid relative onto said plurality of turbine blades through said nozzles thereby rotating said turbine blades around said axis; and a brake defined in said at least one attachable member and directing fluid in the direction reverse to the direction of fluid supplied by said nozzles with said brake driving fluid onto said turbine blades to decrease a rotational speed of said rotatable turbine wheel.

41. A rotational atomizer turbine as set forth in claim 40 wherein said at least one attachable member is further defined by a circular plate having a plurality of nozzles defined in said circular plate for driving fluid in an angular direction onto said turbine blades.

42. A rotational atomizer turbine as set forth in claim 41 wherein said brake is further defined by a nozzle formed in said circular plate.

43. A rotational atomizer as set forth in claim 42 including a first inlet defined in said intermediate chamber for delivering fluid into said intermediate chamber.

44. A rotational atomizer as set forth in claim 43 including at least one second inlet defined in said intermediate chamber for delivering fluid into said intermediate chamber thereby increasing amount of fluid in said intermediate chamber to increase a rotational speed of said rotatable turbine wheel as fluid is introduced to said turbine blades through said plurality of nozzles.

45. A rotational atomizer turbine as set forth in claim 44 wherein said intermediate chamber presents an annular form and circumscribes said axis of said turbine wheel extending in a radial direction surrounding said turbine wheel externally.

46. A rotational atomizer turbine as set forth in claim 41 wherein said nozzles present an annular distance defined between said nozzles and said turbine wheel for driving fluid onto every other of said turbine blades to reduce vibration of said rotatable turbine wheel thereby improving a driving torque of said rotatable turbine wheel.

47. A rotational atomizer turbine as set forth in claim 41 wherein said nozzles are asymmetrically disposed relative said axis.

48. A rotational atomizer turbine as set forth in claim 44 wherein said first inlet, said at least one second inlet, and said brake nozzle are fluidly and separately communicated with supply lines for receiving fluid.

49. A rotational atomizer turbine as set forth in claim 48 wherein said supply lines are defined by hoses.

50. A rotational atomizer turbine as set forth in claim 41 wherein said housing is further defined by a front plate, a neck portion, and a second circular plate with said circular plate defining said intermediate chamber disposed between said front plate and said second circular plate.

51. A rotational atomizer turbine fluidly communicated with a source of pressurized fluid supply for rotating a bell for atomizing paint, said rotational atomizer turbine comprising:

a housing having a pair of plates detachable with respect to one another;

a rotatable shaft disposed in said rotational atomizer turbine and having first and second ends with said second end presenting operative communication with the bell;

a plurality of turbine blades radially disposed around said second end; and an intermediate chamber defined between said plates and partially exposed to said turbine blades with said intermediate chamber having a plurality of inlets for fluidly communicating with the source of pressurized fluid supply and a plurality of nozzles radially spaced around said turbine blades thereby producing driving force to said turbine blades from the source of pressurized fluid supply for rotating the bell.

52. A rotational atomizer turbine fluidly communicating with a source of fluid supply for driving a bell of a rotational atomizer for a coating unit, said rotational atomizer turbine comprising:

a housing defined by at least one attachable member, a front plate, a neck portion, and a second circular plate with said housing surrounding an axis and a plurality of nozzles defined in said second circular plate;

a rotatable turbine adaptable for rotating the bell is disposed in said housing surrounding the axis, a plurality of turbine blades of said rotatable turbine radially spaced relative to the axis and rotatabale about the axis as said nozzles drive fluid on said blades in an angular direction, and an intermediate chamber disposed between said front plate and said second circular plate with said intermediate chamber being partially exposed to said plurality of turbine blades at spaced locations for distributing fluid from the source of fluid supply and to direct fluid relative to said plurality of turbine blades thereby rotating said turbine blades around the axis.

* * * * *